United States Patent [19]

Sanders

[11] Patent Number: 5,046,277

[45] Date of Patent: Sep. 10, 1991

[54] MOUNTING DEVICE FOR SIGHT VIEWING APPARATUS

[76] Inventor: Ronald J. Sanders, P.O. Box 658, Floodwood, Minn. 55736

[21] Appl. No.: 459,544

[22] Filed: Jan. 2, 1990

[51] Int. Cl.[5] ..... F41G 1/38; F41G 1/32; F41G 1/16

[52] U.S. Cl. ..... 42/101; 42/100; 33/245; 362/110

[58] Field of Search ..... 42/100, 101, 103, 102; 33/245, 247, 250, 252; 362/110

[56] References Cited

U.S. PATENT DOCUMENTS

| | | | |
|---|---|---|---|
| 374,202 | 12/1887 | Rice | 33/247 |
| 523,887 | 7/1894 | Favre | 33/254 |
| 807,993 | 12/1905 | Bassell et al. | 33/241 |
| 830,052 | 9/1906 | Chadwick | 33/254 |
| 920,278 | 5/1909 | Deere et al. | 33/241 |
| 1,273,019 | 7/1918 | Wiggins | 33/254 |
| 1,989,245 | 1/1935 | Redfield | 33/244 |
| 2,030,312 | 2/1936 | Mossberg | 33/244 |
| 2,446,970 | 8/1948 | Wilson | 33/254 |
| 2,473,891 | 6/1949 | Lillard | 42/100 |
| 2,484,368 | 10/1949 | Young | 33/252 |
| 2,546,242 | 3/1951 | Stinson | 33/241 |
| 3,325,937 | 6/1967 | Morrow | 42/102 |
| 3,641,676 | 2/1972 | Knutsen et al. | 42/100 |
| 3,834,035 | 9/1974 | Merrill | 42/100 |
| 3,974,585 | 8/1976 | Dunham | 33/241 |
| 4,008,536 | 2/1977 | Adams | 42/100 |
| 4,117,617 | 10/1978 | Linde et al. | 33/252 |
| 4,143,465 | 3/1979 | White | 42/102 |
| 4,458,436 | 7/1984 | Bohl | 42/100 |
| 4,776,126 | 10/1988 | Williams | 42/101 |

OTHER PUBLICATIONS

Williams Gun Sight Company, 1990 Guideline Products brochure, pp. 14–18.

*Primary Examiner*—Michael J. Carone
*Attorney, Agent, or Firm*—Peterson, Wicks, Nemer & Kamrath

[57] ABSTRACT

A mounting device (160) is disclosed including a dove tail groove (184) formed in a bevel surface (168) for slideable receipt on the sight ramp (162) of a slug barrel shotgun. The ramp (162) is captured by collapsing a pinch slit (186) formed in the groove (184). Further, the mounting device (160) is canted by a bolt (190) threadably received in the device (160) and which abuts with the shotgun barrel adjacent the sight ramp (162).

17 Claims, 1 Drawing Sheet

MOUNTING DEVICE FOR SIGHT VIEWING APPARATUS

BACKGROUND

The present invention generally relates to mounting devices for sight apparatus, and particularly to devices for mounting sight apparatus to firearm weaponry, non-firearm weaponry, or other types of apparatus requiring fast, precise, and effective sighting and/or aiming.

Although the features of this invention, which are believed to be novel, are set forth in the claims, details as to its organization and method of operation, together with the further objects and advantages thereof, may be best understood through reference to the following description taken in connection with the accompanying drawings.

DESCRIPTION OF THE DRAWINGS

The illustrative embodiment may best be described by reference to the accompanying drawings where.

Figure 1:
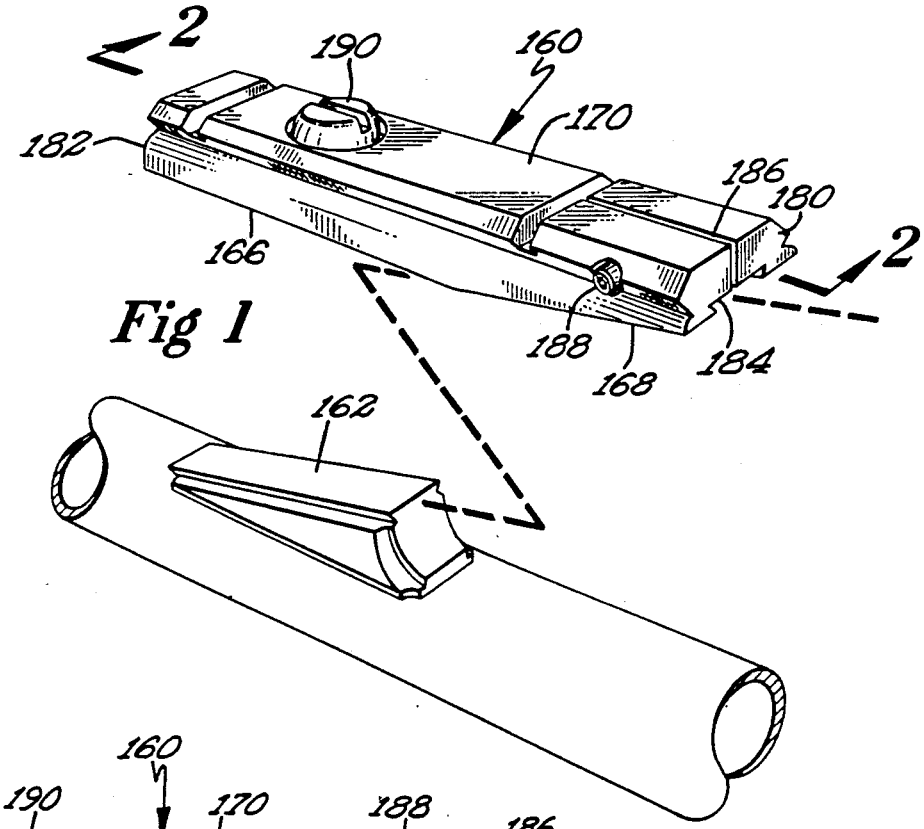
FIG. 1 shows a, perspective view of a mounting device according to the preferred teachings of the present invention exploded from a slug barrell.
Figure 2:
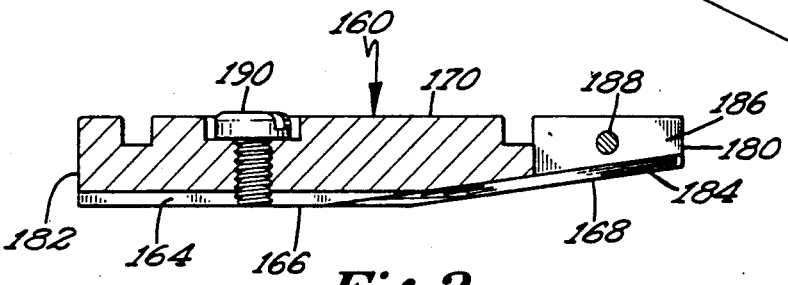
FIG. 2 shows a cross sectional view of the mounting device of FIG. 1 according to section line 2—2 of FIG. 2.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "bottom", "upper", "lower", "front", "rear", and similar terms are used herein, it should be understood that these terms have reference only to the structure shown in the drawings as it would appear to a person viewing the drawings and are utilized only to facilitate describing the invention.

DESCRIPTION

In its most preferred form, a mounting device 160 adapted to be releasably secured to the sight ramp 162 of slug barrel shotguns according to the preferred teachings of the present invention is shown in the drawings. Slug barrel ramps 162 are dove tail shaped and integrally formed on the slug barrel and extending at an angle therefrom. Device 160 in its most preferred form has an extruded body cut to length, with the configuration of standard firearm base 170 formed on the upper portion thereof. A central, longitudinally extending recess 164 is formed in the bottom surface 166 of the lower portion thereof and of a size and shape complementary to and for straddling the barrel in front of ramp 162. Bottom surface 166 is beveled along a bevel surface 168 at an angle corresponding to the angle of ramp 162 from bottom surface 166 at a point intermediate ends 180 and 182 to end 180. A dove tail groove 184 is formed in and parallel to surface 168 from end 180 to recess 164. Groove 184 has a size and shape complementary to and for slidable receipt on ramp 162. In the most preferred form, groove 184 has a constant width generally equal to the width of ramp 162 and less than the width of recess 164. A vertical pinch slit 186 is located within groove 184 extending from end 180 for approximately one half the length of surface 168. Provisions 188 such as a screw may be provided to close or collapse pinch slit 186 and capture ramp 162 when slideably received in groove 184. Provisions 190 are provided for abutting against the barrel to support device 160 relative thereto and for canting groove 184 and device 160 relative to ramp 162 for kickback support such as a nylon bolt threadably received in device 160 generally perpendicular to bottom surface 166 within recess 164 and intermediate end 182 and surface 168 as shown.

In use, device 160 is attached to the slug barrel by sliding groove 184 down ramp 162 until recess 164 straddles the shotgun barrel. After placement, screw 188 may be tightened to close pinch slit 186 and tightly grip groove 184 on ramp 162. Further, bolt 190 may be extended to abut the slug barrel to support device 160 and to cant groove 184 relative to ramp 162. Thus, device 160 is very tightly secured to ramp 162 without requiring drilling or tapping the slug barrel. After securement of device 160, sight viewing apparatus may be secured to base 170 of device 160 utilizing mounting provisions thereof according to the teachings of the present invention. Mounting device 160 according to the teachings of the present invention may be utilized to mount various sighting apparatus to ramps 160 of firearms or non-firearms. Therefor, mounting device 160 is advantageous for obtaining full benefit of extended eye relief viewing and sighting for slug barrel shotguns or like devices including ramps.

Now that the basic teachings of the present invention have been explained, many extensions and variations will be obvious to one having ordinary skill in the art. For example, although mounting device 160 is shown and described in the preferred form utilized with a shotgun, it will be immediately apparent to one skilled in the art that mounting device 160 according to the teachings of the present invention may be utilized with other types of firearm weaponry such as rifles or pistols, with other types of weaponry such as bows, crossbows, or paint ball guns, or with other types of apparatus requiring fast, precise, and effective sighting and/or aiming.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. Device for mounting sighting apparatus on apparatus requiring sighting or aiming and having sight ramps of a dovetail shape comprising, in combination: a body including an upper portion, a lower portion, a first end, and a second end, with the lower portion having a bottom surface; means formed on the upper portion of the body for mounting the sighting apparatus to the body; a bevel surface extending from the bottom surface intermediate the first and second ends of the body at an angle corresponding to the angle of the sight ramp and to the first end; a dovetail groove formed in and parallel to the bevel surface of a size and shape complementary to and for slidable receipt on the sight ramp; means for capturing the sight ramp in the dovetail groove; and means for canting the body relative to the sight ramp.

2. The mounting device of claim 1 wherein the canting means comprises a bolt threadably received in the body generally perpendicular to the bottom surface and located intermediate the second end of the body and the bevel surface for abutting with the apparatus requiring sighting or aiming.

3. The mounting device of claim 2 further comprising, in combination: a recess formed in the bottom surface and intersecting with the dovetail groove, with the bolt located in the recess, with the recess being of a size and shape complemenary to and for straddling the apparatus requiring sighting or aiming adjacent to the sight ramp.

4. The mounting device of claim 3 wherein the capturing means comprises, in combination: a pinch slit formed in the dovetail groove; and means for collapsing the pinch slit.

5. The mounting device of claim 4 wherein the mounting means comprises a configuration of a standard firearm base formed in the upper portion of the body.

6. The mounting device of claim 5 wherein the apparatus requiring sighting or aiming comprises the slug barrel of a shotgun.

7. The mounting device of claim 1 wherein the capturing means comprises, in combination: a pinch slit formed in the dovetail groove; and means for collapsing the pinch slit.

8. The mounting device of claim 7 wherein the canting means comprises a bolt threadably received in the body generally perpendicular to the bottom surface and located intermediate the second end of the body and the bevel surface for abutting with the apparatus requiring sighting or aiming.

9. The mounting device of claim 8 wherein the mounting means comprises a configuration of a standard firearm base formed in the upper portion of the body.

10. The mounting device of claim 8 wherein the apparatus requiring sighting or aiming comprises the slug barrel of a shotgun.

11. The mounting device of claim 8 further comprising, in combination: a recess formed in the bottom surface and intersecting with the dovetail groove, with the bolt located in the recess, with the recess being of a size and shape complementary to and for straddling the apparatus requiring sighting or aiming adjacent to the sight ramp.

12. The mounting device of claim 1 wherein the apparatus requiring sighting or aiming comprises the slug barrel of a shotgun.

13. The mounting device of claim 1 wherein the mounting means comprises a configuration of a standard firearm base formed in the upper portion of the body.

14. Device for mounting sighting apparatus on apparatus requiring sighting or aiming having sight ramps of a dovetail shape comprising, in combination: a body including an upper portion, a lower portion, a first end, and a second end, with the lower portion having a bottom surface; means formed on the upper portion of the body for mounting the sighting apparatus to the body; a dovetail groove formed in the body of a size and shape complementary to and for slideable receipt on the sight ramp; means for capturing the sight ramp in the dovetail groove; and means for canting the body relative to the sight ramp.

15. The mounting device of claim 14 wherein the canting means comprises a bolt threadably received in the body for abutting with the apparatus requiring sighting or aiming.

16. Device for mounting sighting apparatus on apparatus requiring sighting or aiming having sight ramps comprising, in combination: a body including an upper portion, a lower portion, a first end, and a second end, with the lower portion having a bottom surface; means formed on the upper portion of the body for mounting the sighting apparatus to the body; a groove formed in the body of a size and shape complementary to and for slideable receipt on the sight ramp; a pinch slit formed in the groove; means for collapsing the pinch slit for capturing the sight ramp in the groove; and means for canting the body relative to the sight ramp.

17. The mounting device of claim 16 wherein the canting means comprises a bolt threadably received in the body for abutting with the apparatus requiring sighting or aiming.

* * * * *